US005136814A

United States Patent [19]

Headrick

[11] Patent Number: 5,136,814

[45] Date of Patent: Aug. 11, 1992

[54] DRAINING DOOR SILL ASSEMBLY WITH ADJUSTABLE THRESHOLD CAP

[75] Inventor: J. Charles Headrick, Norcross, Ga.

[73] Assignee: Headrick Management Corporation, Norcross, Ga.

[21] Appl. No.: 697,665

[22] Filed: May 9, 1991

[51] Int. Cl.[5] ..... E06B 1/70

[52] U.S. Cl. ..... 49/468; 49/469; 49/471

[58] Field of Search ..... 49/468, 471, 469, 470

[56] References Cited

U.S. PATENT DOCUMENTS

| | | | |
|---|---|---|---|
| 212,521 | 2/1879 | Stewart | 49/471 |
| 385,065 | 6/1888 | Milroy | 49/471 |
| 582,451 | 5/1897 | Brannon | 49/471 |
| 3,273,287 | 9/1966 | Pease, Jr. | 49/468 |
| 3,501,866 | 3/1970 | Johnson | 49/380 |
| 3,762,100 | 10/1973 | Kempel | 49/468 |
| 3,851,420 | 12/1974 | Tibbetts | 49/471 |
| 3,967,412 | 7/1976 | Governale | 49/468 |
| 4,074,464 | 2/1978 | McCay | 49/468 |
| 4,224,766 | 9/1980 | Procton | 49/468 |
| 4,352,258 | 10/1982 | Bursk et al. | 49/468 |
| 4,387,535 | 6/1983 | Corbo | 49/468 |
| 5,012,614 | 5/1991 | Shea | 49/468 |

*Primary Examiner*—Philip C. Kannan
*Attorney, Agent, or Firm*—Hopkins & Thomas

[57] ABSTRACT

A draining threshold and door sill assembly has an elongated frame member forming an upwardly open channel and a sill that slopes away from the channel. A threshold cap is removably captured within the channel and protrudes slightly thereabove. An end cap is securely fastened to an end of the assembly and is formed with a drain trough that extends transversely beneath the end of the assembly. The drain trough has a first portion that at least partially underlies the end of the channel and extends to a mouth at the outside edge of the assembly. Rain water that seeps under the threshold cap and into the channel flows to the end of the channel and into the drain trough of the end cap, which directs the water beyond the outside edge of and away from the assembly. The threshold cap has no openings in the top thereof and is vertically adjustable in the channel by means of a set of threaded pedestals that depend from the bottom of the threshold cap and rest on the floor of the channel. The pedestals can be threaded into and out of the threshold cap to adjust the vertical position of the cap within the channel.

18 Claims, 3 Drawing Sheets

DRAINING DOOR SILL ASSEMBLY WITH ADJUSTABLE THRESHOLD CAP

TECHNICAL FIELD

This invention relates generally to door sills and more particularly to extruded aluminum threshold and door sill assemblies.

BACKGROUND OF THE INVENTION

Threshold and sill assemblies have long been used beneath entranceway doors to provide a variety of advantages including the prevention of heat loss under the door and the draining of rain water away from the entranceway. For many years, such assemblies have been constructed of wood and typically include an upwardly extending threshold cap portion positioned to engage a metal or rubber-like weather strip or wiper secured along the bottom of the closed door to create a seal against heat loss. While such wooden threshold assemblies are adequate for their intended purposes, they nevertheless tend to be susceptible over time to wear and tear and to expansion, contraction, and rot as a result of the continuously changing moisture conditions in the atmosphere. As a result, wooden threshold assemblies eventually become ineffective and require replacement.

In recent years, threshold assemblies constructed of extruded aluminum or aluminum alloys have been introduced as alternatives to their wooden counterparts. Many of these aluminum assemblies include a wood, plastic, or aluminum threshold cap that underlies a closed door and that can be adjusted up or down at the time the door unit is installed to insure a tight fit between the door bottom and the cap. Further, if the originally established fit between the cap and door bottom deteriorates over time because of wear of the cap or settlement of the dwelling, the threshold cap of these assemblies can simply be readjusted to bring the fit back to its original integrity. Examples of aluminum threshold and sill assemblies of the type discussed are found in U.S. Pat. Nos. 4,447,987 of Lesosky, 3,762,100 of Kimpel 3,273,287 of Pease, 3,967,412 of Governale, and 4,352,258 of Bursk et.al.

Extruded aluminum sill and threshold assemblies have generally represented improvements over wooden thresholds because of their resistance to wear and tear and because they do not rot or otherwise deteriorate over time. Nevertheless, such assemblies have typically been plagued by a number problems and shortcomings inherent in their own respective designs. Specifically, even though a gasket is usually provided along the interface between the threshold cap and the aluminum body of the sill, rain water still tends to seep through the interface and thus leak under the cap and into the region beneath the assembly. Even more serious leaks can and many times do develop at the ends of these threshold and sill assemblies where they are secured to the bottoms of the vertical door frame jambs. Such leaks can be intensified during blowing rain storms and can eventually lead to serious rotting of flooring and structural joists that underlie the threshold assembly.

Another shortcoming of prior art aluminum threshold assemblies is that their associated threshold caps typically are vertically adjustable by means of a set of adjustment screws whose slotted heads protrude through corresponding holes in the top of the threshold cap While this arrangement provides for easy adjustment with a simple screwdriver, the holes through which the screw heads protrude provide yet another pathway for water to seep through and under the threshold cap to deteriorate flooring thereunder Furthermore, the holes and adjustment screw heads tend to fill with dirt and debris over time, which can be unsightly, unsanitary, and can make it difficult to perform the adjustments for which the screws are intended.

Thus, a continuing and heretofore unaddressed need exists for an improved threshold and door sill assembly that effectively prevents seepage of rainwater through and around the assembly and that has an adjustable threshold cap that is void of holes through which water can leak and that has no exposed adjustment means to collect dirt. The present invention is such an assembly.

SUMMARY OF THE INVENTION

The present invention in one preferred embodiment thereof comprises a threshold and door sill assembly for installation in the entranceways of dwellings and other buildings. The assembly includes an elongated frame formed from a unitary piece of extruded aluminum or other metal alloy. The frame is shaped to define a longitudinally extending upwardly open channel for holding a sill cap beneath the bottom of a closed door. A flat sill portion extends transversely and slopes downwardly from one side of the channel. Rain water falling on the sill or running down the exterior surface of a closed door onto the sill tends to run down the sill to a position displaced from the threshold and away from the entranceway of the dwelling.

The channel formed by the frame is configured to receive and hold securely an elongated threshold cap, which protrudes slightly from the channel and against the upper surface of which the door's bottom weather strip can form a seal when the door is closed. The bottom of the threshold cap is formed to receive a set of spaced threaded lugs through which a corresponding set of threaded pedestals can be selectively advanced and retracted. The bottom ends of the pedestals are formed with wide slotted heads that rest on the floor of the channel and support the threshold cap at a predetermined vertical position therein. The threshold cap can thus be vertically adjusted by removing it temporarily from the channel, adjusting the pedestals to the proper position, and replacing the cap into the channel. A rubberized snugger strip extends along the front edge of the channel and functions to capture and hold the threshold cap snuggly and securely in the channel. The snugger strip also functions as a gasket to reduce seepage of rainwater into the channel.

The floor of the channel is formed with a small gutter that extends along the forward edge of the channel from one end of the channel to the other. Securely mounted to each end of the frame is an end cap that is preferably fabricated of plastic or other suitable material and that is formed with a drain trough that extends transversely beneath the end of the assembly to a mouth at the forward edge of the assembly. The trough of each end cap underlies corresponding ends of the channel and gutter and the edge of the sill portion of the extruded aluminum body. Each trough also extends beyond the end of the aluminum body to underlie a portion of the bottom of a vertical door jamb secured to the assembly.

In use, the threshold and sill assembly of this invention is installed as the threshold of a door frame system. More specifically, the vertically extending door jambs of the frame are secured at there lower ends to the ends of the threshold assembly by means of staples or the like that are driven directly into the material of the end caps. The door frame system is then installed in the entranceway of a building structure and a door is hingedly secured to one of the jambs. The threshold cap can then be removed temporarily and the position of its threaded pedestals set to support the cap in its channel at a height sufficient to create a seal with the door's bottom weather strip when the door is closed. The threshold cap is then pressed into its channel where the snugger strip holds its securely in place.

With the assembly thus installed and the door closed, rainwater that may seep under the threshold cap at the interface of the cap and snugger strip flows into and is directed along the length of the gutter formed in the floor of the channel. At the ends of the gutter, the water falls into the underlying transversely extending troughs of the end caps. The troughs, then, direct the water to their mouths at the forward edge of the assembly where the water is expelled and drains away from the dwelling entranceway. Furthermore, water that may run down the vertical door jambs and seep thereunder along the ends of the sill is also captured in the end cap troughs and directed out the front of the assembly since the troughs extend beyond the end of the assembly to underlie a portion of the jambs.

Thus, a threshold and sill assembly is now provided that includes a fully adjustable threshold cap having no exposed adjustment screws to collect dirt and no holes through which water can leak. Furthermore, any water that does seep through or around the assembly either at the interface of the threshold cap and its channel or under the lower edge of the vertical door jambs, is directed to and captured by the end cap troughs, which further direct the water out the front of the assembly. Therefore, no water leaks under the assembly to rot or otherwise deteriorate the wood of the building's entranceway framing.

These and other objects, features, and advantages of the invention will become more apparent upon review of the following detailed description whe.. taken in conjunction with the accompanying drawings.

DETAILED DESCRIPTION OF THE PREFERRED EMBODIMENT

Figure 1:
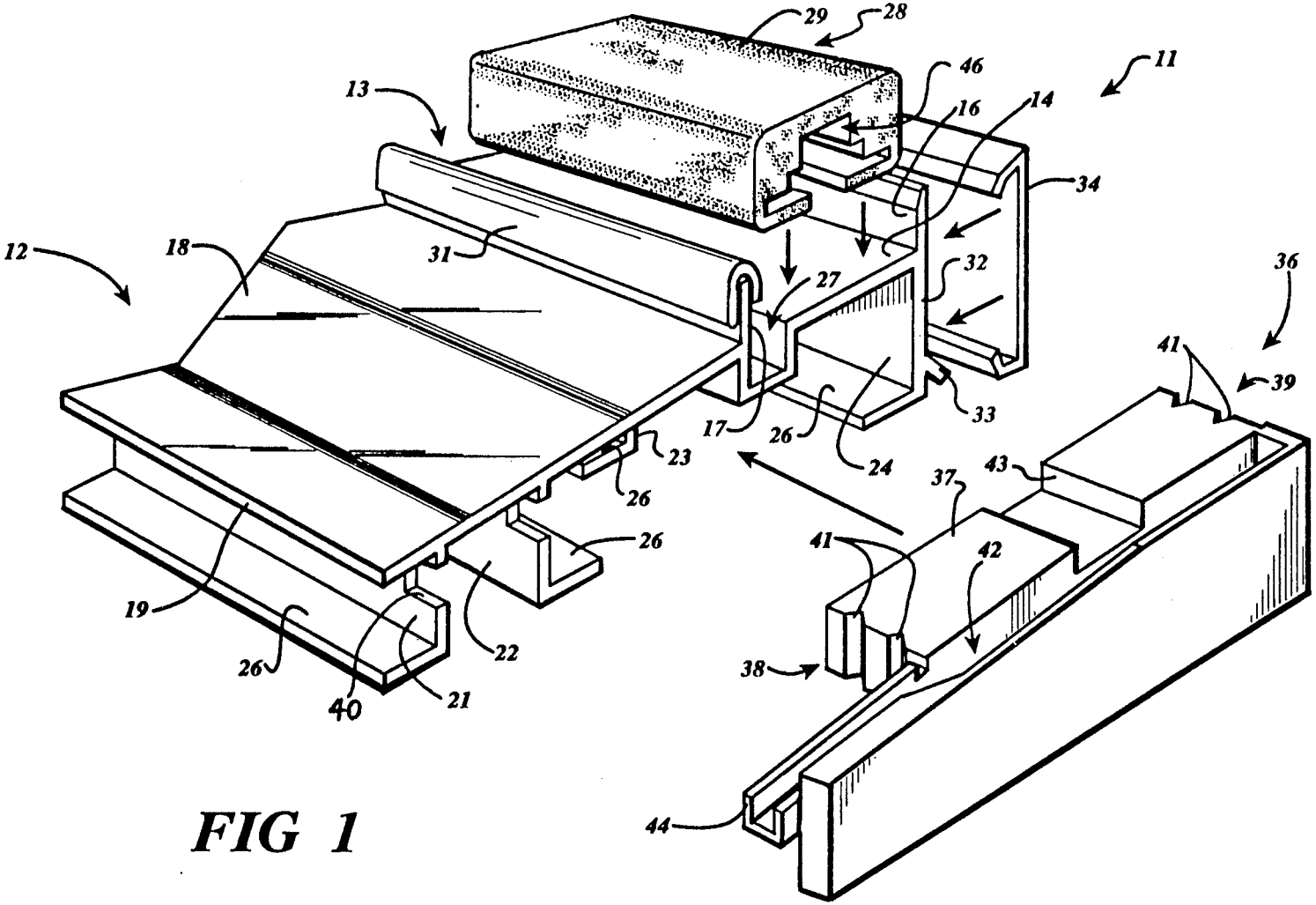
FIG. 1 is a perspective exploded view of an end portion of the assembly of this invention showing the extruded frame, the end cap, the threshold cap, and the snugger strip.

Referring now in more detail to the drawings, in which like numerals refer to like parts throughout the several views, FIG. 1 illustrates one end portion of a threshold and door sill assembly that embodies principles of the present invention in a preferred form. The assembly 11 is seen to comprise an elongated frame member 12 that is preferably formed of a unitary length of extruded aluminum or other metal alloy resistant to wear and tear and not subject to expansion and contraction due to moisture absorption. The frame member 12 is formed with a longitudinally extending upwardly open channel 13 that has a floor 14, a rear wall 16, and a front wall 17. A sill portion 18 of the frame member 12 extends laterally from the front wall 17 of the channel 13 and slopes downwardly therefrom to an outside edge 19 of the assembly.

A set of vertical supports 21, 22, 23, and 24 respectively, depend from the underside of the frame member 12 and function to rest upon and support the assembly above flooring and framing members that form the threshold of an entrance. The supports 21, 22, 23, and 24 are preferably formed with laterally extending feet portions 26 that rest firmly upon the threshold framing.

The frame member 12 is further formed to define an elongated gutter 27 that extends along the forward edge of the channel 13 from one end of the assembly to the other end thereof. An elongated threshold cap 28 is sized and configured to be received and supported within the channel 13 with at least a portion of the threshold cap 28 protruding upwardly from the channel. The threshold cap 28 is preferably formed of a wear resistant plastic material and can be fabricated expediently if desired through a common extrusion process. The upper surface 29 of the threshold cap 28 is seen to be uninterrupted by openings or holes that extend through the threshold cap.

An elongated preferably rubberized snugger strip 31 extends about the upper edge of the channel front wall 17. The snugger strip 31 is generally "U" shaped and captures the top edge of the front wall 17 between its opposed legs. The snugger strip 31 serves two advantageous functions in the invention. First, as the threshold cap 28 is inserted into the channel 13, it becomes securely yet removably captured between the snugger strip 31 and the rear wall 16 of the channel 13. In this way, the threshold cap does not become dislodged from the channel during normal use but can be removed with a screwdriver or the like when desired for adjustment, as detailed below. Secondly, the snugger strip 31 functions as a gasket that helps reduce seepage of rainwater and other moisture at the interface between the threshold cap and the channel wall, thus reducing the amount of water that seeps or leaks into the channel 13.

The rear surface 32 of the frame member 12 is formed with a lower tang 33 that, in conjunction with the upper edge of the rear surface 32, receives and securely holds a moisture barrier 34 formed of plastic or other insulating material. The moisture barrier 34 serves to prevent condensation of moisture that otherwise might form on the rear surface of the frame member 12 by eliminating circulation of air directly adjacent the metal rear surface 32 of the assembly. In this way, condensate is prevented by the moisture barrier 34 from forming and dripping onto the floor on the inside of a dwelling or other building structure.

An end cap 36 is adapted to be mounted and secured to the end of the frame member 12. The end cap 36 includes a mounting block 37 that has front and rear surfaces 38 and 39 each having a pair of parallel notches 41 formed therein. The front and rear surfaces 38 and 39 of the mounting block 37 are positioned to bear against the faces of supports 22 and 24 respectively when the end cap 36 is inserted onto the end of the frame member 12 as indicated by the arrow. The surfaces of the supports can then be crimped at the positions of notches 41 to form barbs that extend into the notches and secure the end cap firmly in place on the end of the assembly.

The end cap 36 is formed to define a drain trough 42 that extends the length of the end cap. The trough 42 is configured to extend transversely beneath the end of the frame member 12 when the end cap 36 is mounted thereto. With the end cap thus mounted, the rear end portion of the trough 42 underlies the end of the channel 13 and the end of the gutter 27 formed therein. A notch 43 is formed in the mounting block 37 to accommodate the gutter 27. The lower end 44 of the trough 42 is configured to extend through a notch 40 in support 21 and form a mouth just below the outside edge 19 of the sill portion 18 of the frame 12. The trough 42 also extends slightly beyond the end of the frame member 12 such that the trough also underlies the bottom end of a vertical door jamb secured to the sill assembly as more fully detailed below.

With the just described configuration, it can be seen that with the end cap in place, rainwater that might seep between the snugger strip 31 and the threshold cap 28 and into the channel 13, tends to be collected in the gutter 27. The collected water then flows down the gutter 27 to the end thereof where it falls into and is captured by the trough 42 of the end cap 36. The captured water then flows down the trough 42 and is expelled through the mouth of the trough just beneath the outside edge of the sill. The water can then drain away from the threshold and sill assembly where it can do no harm to framing members therebeneath. Further, water that flows down the vertical door jambs of an entranceway and seeps around the end of the sill assembly is also captured by the end cap troughs and directed out the front of the assembly.

Figure 2:
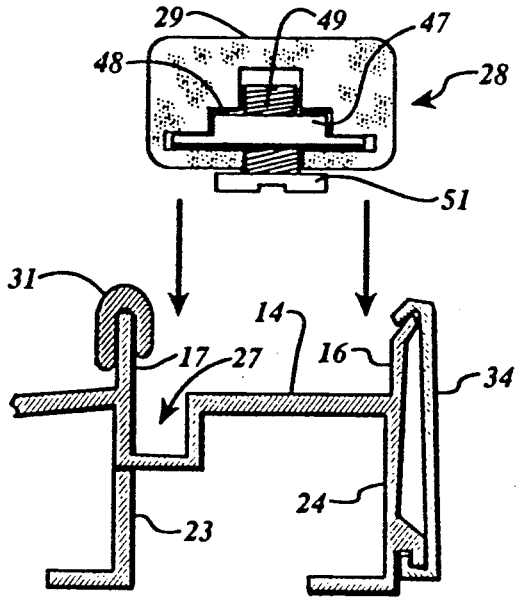
FIG. 2 is an end elevational view of the rear portion of the assembly showing placement of the threshold cap in its channel and the adjustable pedestals that support the threshold cap in the channel.

FIG. 2 is an end elevational view of the rear portion of the assembly showing placement of the threshold cap in the channel and means for adjusting the vertical position of the threshold cap within the channel. More specifically, the threshold cap 28 is seen to be extruded with a structured groove that extends along the length of the underside of the threshold cap. The groove is configured and sized to receive a set of threaded lugs 47 having shoulders 48 that bear against surfaces of the structured groove 46. A set of threaded pedestals 49 are configured to be received into corresponding ones of the threaded lugs 47. The pedestals 49 can thus be advanced into and out of the threshold cap 28 through their corresponding lugs 47.

Each pedestal is provided with a wide slotted head 51 that can be used to adjust the position of the pedestal within the threshold cap using a common screwdriver. Furthermore, when the threshold cap is positioned in the channel 13, the heads 51 of the pedestals 49 rest on the bottom 14 of the channel, thus supporting the threshold cap at a predetermined vertical position within the channel 13. It can thus be seen that the vertical position of the threshold cap can be adjusted by removing the threshold cap temporarily from the channel, advancing or retarding the threaded pedestals 49 to predetermined positions, and replacing the threshold cap in the channel. Since all adjustment is performed from the bottom of the threshold cap, there are no holes, protrusions or other interruptions in the top thereof, as is true with prior art threshold caps. The threshold cap of this invention, therefore, eliminates collection of unsightly and unsanitary dirt and prevents water seepage through its top surface into the channel 13.

The rear wall 16 of the channel 13 is seen in FIG. 2 to be tapered slightly from its bottom to its top. This configuration tends to ensure a tight fit for the threshold cap 28 when it is captured securely between the snugger strip 31 and the rear wall 16 of the channel.

Figure 3:
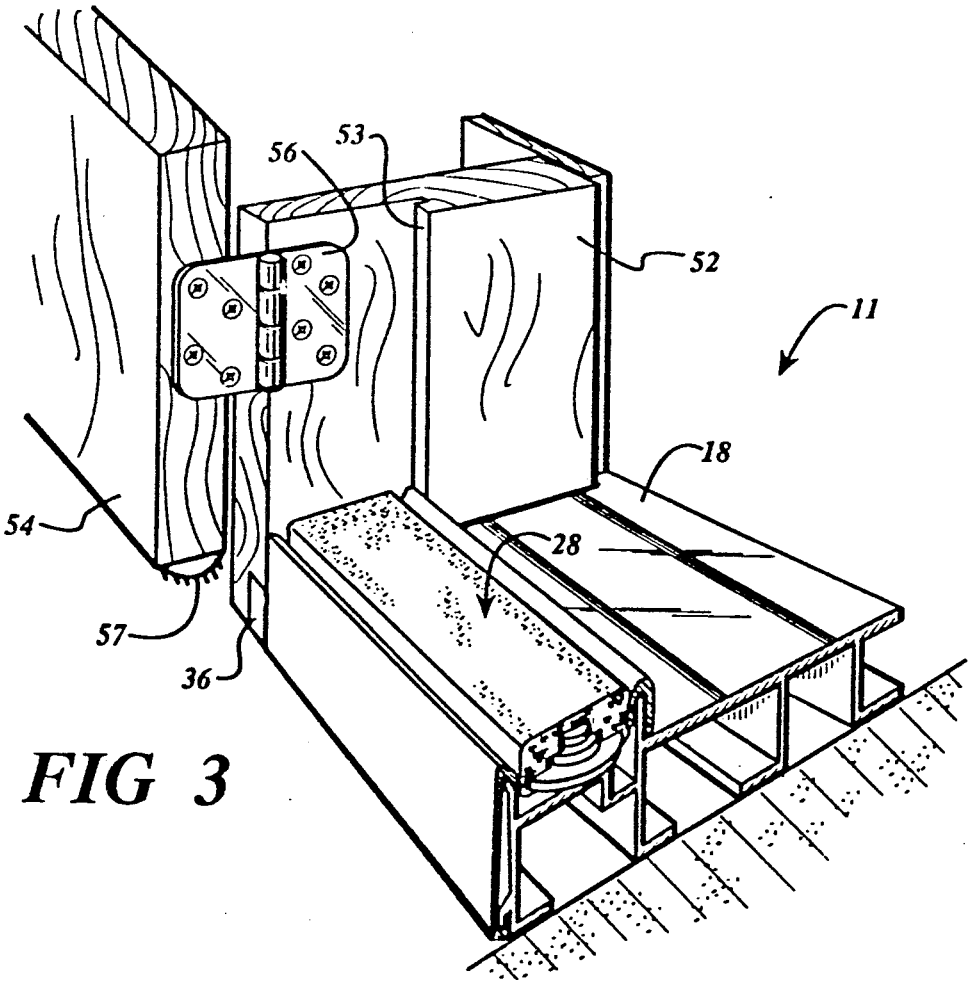
FIG. 3 is a perspective partially sectional view of the present invention as it appears when installed in a door frame system and showing attachment of the bottom of a vertical door jamb to the end of the threshold assembly.

FIG. 3 is a perspective partially sectional view of the assembly of this invention shown as an integral part of a door frame system. A vertical door jamb 52 is seen to be secured at its lower end to one end of the threshold and sill assembly 11. The jamb 52 is typically formed with a shoulder 53 that can accommodate a weather strip for bearing against the closed door and preventing loss of heat through the door. The jamb 52 can be secured at its bottom to the end of the sill assembly 11 by means of staples or the like that are driven through the bottom of the jamb and into the material of the end cap 36. The end cap 36 thus not only provides for drainage of rainwater, it also provides a convenient means for securing the door jamb to the ends of the assembly.

A door 54 is hingedly secured to the door jamb 52 by means of a set of hinges 56, only one of which appears in the drawing of FIG. 3. The lower edge of the door 54 is commonly provided with a weatherstrip 57 that wipes and bears against the threshold cap 28 when the door is closed to prevent loss of heat beneath the door. FIG. 3 also illustrates one of the set of threaded lugs and pedestals that form the hidden threshold cap adjusting and support means of the present invention.

Figure 4:
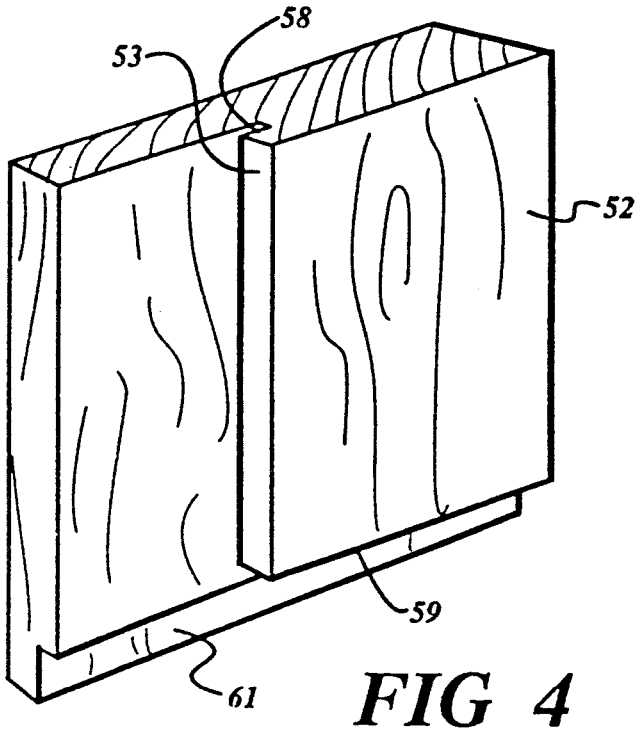
FIG. 4 is a perspective partially sectional view of the lower end of a vertical door jamb for use with the assembly of the present invention.

FIG. 4 shows the bottom end portion of a vertical door jamb that might be used with the assembly of the present invention. Jamb 52 is seen to be formed with a shoulder 53 having a notch 58 sized to receive a length of weatherstrip. The forward portion of the jamb 52 has a bottom 59 that protrudes from the jamb and is configured to extend slightly over the upper surface of the sill portion 18 of the assembly 11. A dado 61 is formed in the bottom of the jamb 52 to accommodate the end cap 36, which protrudes slightly beyond the end of the assembly 11 such that its drain trough underlies the bottom end of the jamb.

Figure 5:
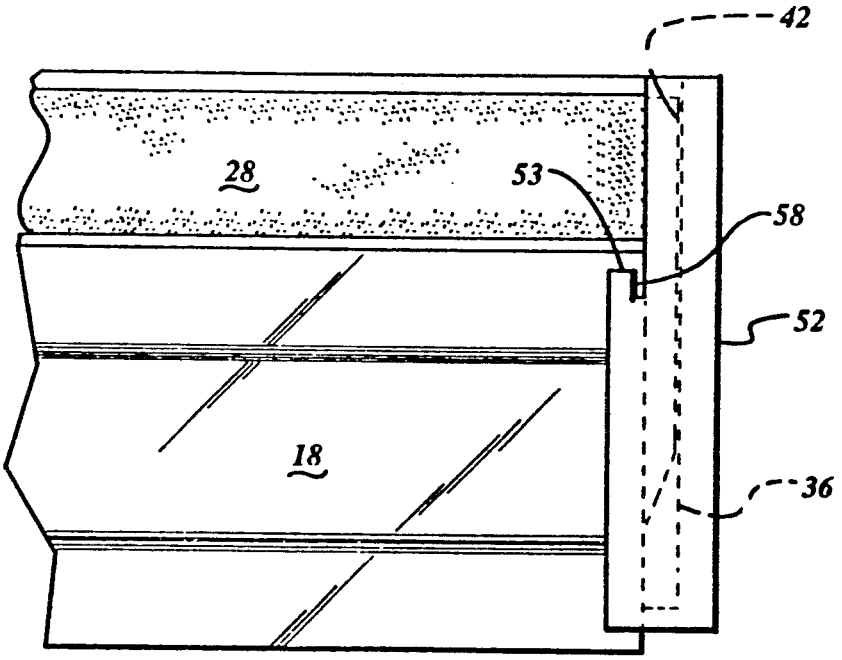
FIG. 5 is a top plan view of an end portion of the assembly of this invention showing how a portion of the end cap trough underlies the end of the channel, the end of the sill, and the bottom end of the vertical door jamb.

FIG. 5 is a top plan view of an end of the threshold and sill assembly showing the spacial relationships of the assembly end, the end cap, and the door jamb. The end cap 36 is seen to extend slightly beyond the end of the extended aluminum frame member when it is securely mounted thereto. In this way, the span of the trough 42 extends beyond the end of the frame member 12 to underlie the bottom edge of the vertical jamb 52 as shown in phantom lines in FIG. 5. This configuration ensures that rainwater collected in the channel and its gutter flows freely to the end of the gutter and into the end cap trough 42. Further, any rainwater that collects along and flows down the groove 58 and the shoulder 53 to the bottom of the jamb, which is a common leakage point in threshold assemblies, will also fall from the end of the sill assembly into the drain trough 42 of the end cap 36. In this way, not only is water seeping under the threshold cap captured and directed away from the assembly, water that runs down the jamb and seeps around the end of the sill assembly is also collected in the trough 42 and directed away from the assembly. As a consequence, seepage of water beneath the assembly and onto framing members of the dwelling threshold structure is virtually eliminated. Consequently, the rot and deterioration often associated with prior art threshold assemblies is also eliminated.

The invention has been described herein in terms of a preferred embodiment. It will be obvious to those of skill in the art, however, that many modifications, deletions, and additions might be made to the illustrated embodiment without departing from the spirit and scope of the invention as set forth in the claims.

I claim:

1. A threshold and door sill assembly comprising:

an elongated frame member formed with a longitudinally extending upwardly open channel and a sill shaped to provide a surface that extends laterally and slopes downwardly from one side of said channel to an outside edge of said frame member;

an elongated threshold cap sized and configured to be received and supported within said channel with at least a portion of said threshold cap protruding upwardly from said channel;

an end cap adapted to be securely mounted to one end of said elongated frame member with said end cap being formed with a drain trough that extends transversely beneath said one end of said frame member;

said drain trough having a first portion positioned at least partially to underlie an end of said channel and an end portion forming a mouth at the outside edge of said frame member when said end cap is mounted to said frame member;

whereby rain water seeping under the threshold cap and into the channel flows to the end of the channel and into the end cap drain trough, which directs the water beyond the outside edge of the frame member and away from the threshold and sill assembly.

2. A threshold and door sill assembly as claimed in claim 1 and wherein said channel is formed with a gutter that extends the length of said channel and wherein said first portion of said end cap drain trough is positioned to underlie an end of said gutter whereby rain water seeping under the threshold cap and into the channel is collected in the gutter and delivered thereby to the drain trough to be directed away from the threshold and sill assembly.

3. A threshold and door sill assembly as claimed in claim 1 and wherein said drain trough is further configured at least partially to underlie an end of said sill when said end cap is mounted to said frame member whereby rain water seeping under the assembly at the end of the sill is captured in the drain trough and directed thereby away from the threshold and sill assembly.

4. A threshold and door sill assembly as claimed in claim 1 wherein said channel has a floor and wherein said assembly further comprises means for selectively adjusting the vertical position of said threshold cap within said channel, said means including a set of threaded pedestals depending from and arrayed along the underside of said threshold cap with said pedestals being adapted to rest upon said channel floor and support said threshold cap thereabove, said pedestals being adapted to be threaded into and out of said threshold cap for adjustment of the vertical position of said threshold cap within said channel.

5. A threshold and door sill assembly as claimed in claim 4 and wherein a set of threaded lugs are mounted in the underside of said threshold cap and wherein said pedestals are threadably received within said threaded lugs.

6. A threshold and door sill assembly as claimed in claim 5 and wherein said threaded pedestals are formed with slotted heads at their lower ends whereby the pedestals can be adjusted with a screwdriver and wherein said slotted heads rest upon said channel floor when said threshold cap is positioned within said channel.

7. A threshold and door sill assembly as claimed in claim 6 and wherein said channel has an outside wall with an upper edge and an inside wall with an upper edge and wherein said assembly further comprises a rubberized strip mounted to and extending along the upper edge of said channel outside wall with said rubberized strip being configured to bear firmly against said threshold cap when said threshold cap is in position within said channel whereby the threshold cap is captured firmly between the rubberized strip and the channel inside wall and the rubberized strip forms a gasket to reduce seepage of rain water beneath the threshold cap.

8. A threshold and door sill assembly as claimed in claim 7 and wherein said channel inside wall is tapered outwardly at its upper edge to hold said threshold cap firmly but removably within said channel.

9. A threshold and door sill assembly comprising:

an elongated frame member formed with a longitudinally extending upwardly open channel having a floor, and a sill shaped to provide a surface that extends laterally and slopes downwardly from one side of said channel to an outside edge of said frame member;

an elongated unitary threshold cap having an uninterrupted upper surface and sized and configured to be received and supported within said channel with at least a portion of said threshold cap protruding upwardly from said channel; and adjustment means for selectively adjusting the vertical position of said threshold cap within said channel, said adjustment means including a set of threaded pedestals depending from and arrayed along the underside of said threshold cap with said pedestals being adapted to rest upon said channel floor and support said threshold cap thereabove, said pedestals being adapted to be threaded into and out of said threshold cap from the bottom side thereof for adjustment of the vertical position of said threshold cap within said channel.

10. The threshold and odor sill assembly of claim 9 and wherein said threaded pedestals are formed with slotted heads at their lower ends whereby said pedestals can be threaded into and out of said threshold cap with a screwdriver and wherein said threshold cap is supported above said channel floor upon the slotted heads of said pedestals.

11. The threshold and door sill assembly of claim 10 and further comprising a set of threaded lugs mounted to the underside of said threshold cap and wherein a respective one of said pedestals is threadably secured within a corresponding one of said threaded lugs.

12. In a threshold and door assembly of the type having a threshold cap mounted in an elongated channel and protruding upwardly therefrom and a sill shaped to provide a surface that extends laterally and slopes downwardly from one side of said channel to an outside edge of said assembly, the improvement comprising an end cap on said assembly with said end cap being mounted to one end of said frame member and being formed with a drain trough that extends transversely beneath said one end of said frame member, said drain trough having a first portion positioned at least partially to underlie an end of said channel and an end portion forming a mouth at the outside edge of said assembly, whereby rain water seeping under the threshold cap and into the channel flows to the end of the channel and into the end cap trough, which further directs the water beyond the outside edge of and away from the threshold and sill assembly.

13. In a threshold and door sill assembly of the type having an elongated threshold portion from which a sill portion downwardly slopes to a forward edge, a method of collecting rain water that seeps under the assembly and directing the collected rain water away from the assembly, said method comprising the steps of:

(a) capturing the rain water as it seeps under the assembly;

(b) directing the captured rain water to the ends of the assembly;

(c) receiving the rain water at the ends of the assembly and directing the received water transversely beneath the sloped sill portion of the assembly to the forward edge thereof; and (d) expelling the water from the assembly.

14. The method of claim 13 and wherein step (c) includes providing an end cap on the assembly with the end cap being formed to define a drain trough positioned to receive rain water at the ends of the assembly and direct it to the forward edge thereof.

15. An entranceway door assembly comprising a door frame having spaced vertically extending jambs, a door hingedly secured to one of said jambs, and a threshold and sill assembly extending between and secured to the bottom end portions of said vertically extending jambs, said threshold and sill assembly comprising an elongated frame member formed with a longitudinally extending upwardly open channel and a sill shaped to provide a surface that extends laterally and slopes downwardly from one side of said channel to an outside edge of said frame member, an elongated threshold cap positioned and supported within said channel with at least a portion of said threshold cap protruding upwardly from said channel, an end cap securely mounted to one end of said elongated frame member with said end cap being formed with a drain trough that extends transversely beneath said one end of said frame member, said drain trough having a first portion positioned at least partially to underlie an end of said channel and an end portion forming a mouth at the outside edge of said frame member, whereby rain water seeping under the threshold cap and into the channel flows to the end of the channel and into the end cap drain trough, which directs the water beyond the outside edge of the frame member and away from the threshold and sill assembly.

16. A threshold and door sill assembly comprising an elongated frame member having a threshold portion, a sill portion, ends, and a forward edge; at least one end cap secured to an end of said frame member with said end cap forming member, said though having a portion that at least partially underlies the end of said frame member to capture water that seeps under said assembly at the ends thereof, said end cap and said trough extending beneath said sill portion of said assembly to a mouth at the forward edge of said frame member, whereby water seeping beneath the end of the frame member is collected in the drain trough and directed thereby beneath the sill portion of the assembly to the forward edge thereof for drainage away from the threshold and door sill assembly.

17. The threshold and door sill assembly of claim 16 and wherein said trough extends beyond the end of said frame member a distance sufficient to underlie the bottom of a door jamb secured to the assembly end to collect water seeping under the end of the door jamb, and direct it away from the assembly.

18. A threshold and door sill assembly comprising an elongated body having ends and a forward edge, means on said assembly for collecting rain water that seeps into and under the assembly and directing the collected rain water along the length of said elongated body to the ends thereof, and means on at least one end of said elongated body for capturing rain water directed to such end, directing the captured rain water transversely beneath said body to the forward edge of the assembly, and expelling the rain water from said assembly at the forward edge thereof.

* * * * *